United States Patent [19]

Ito

[11] Patent Number: 5,019,749

[45] Date of Patent: May 28, 1991

[54] BACK-LIGHT DEVICE FOR A VIDEO DISPLAY APPARATUS

[75] Inventor: Norio Ito, Suwa, Japan

[73] Assignee: Seiko Epson Corporation, Tokyo, Japan

[21] Appl. No.: 346,661

[22] Filed: May 3, 1989

[30] Foreign Application Priority Data

May 10, 1988 [JP] Japan ..... 63-113010
Jan. 20, 1989 [JP] Japan ..... 1-11612

[51] Int. Cl.[5] ..... H05B 41/00

[52] U.S. Cl. ..... 315/224; 315/309; 315/311; 315/DIG. 7

[58] Field of Search ..... 315/224, 291, 306, 307, 315/309, 310, 311, DIG. 7

[56] References Cited

U.S. PATENT DOCUMENTS 3,746,921 7/1973 Marshall et al. ..... 315/309 X
4,559,478 12/1985 Fuller et al. ..... 315/224

FOREIGN PATENT DOCUMENTS 0070322 1/1983 European Pat. Off. .
58-80299 5/1983 Japan .
60-225347 11/1985 Japan .
61-258588 11/1986 Japan .
63-164142 7/1988 Japan .

*Primary Examiner*—Robert J. Pascal
*Attorney, Agent, or Firm*—Blum Kaplan

[57] ABSTRACT

A back-light device increases the level of luminance produced by a fluorescent lamp at low and high ambient temperatures by increasing the ballast capacitance at these temperatures. The ballast capacitor can include one or more capacitors made from ceramic or the like. The back-light device can be used with different types of video display apparatuses which employ a transmission-type video display plate.

59 Claims, 5 Drawing Sheets

(cd/m2)

CHARACTERISTICS OF THE PRESENT INVENTION
LUMINANCE
10,000
5,000
CHARACTERISTICS OF THE PRIOR ART
-20
0
20
40
60
(°C)
AMBIENT TEMPERATURE (%)
140
120
100
80
CAPACITANCE
(c)
(b)
(a)
CHARACTERISTICS SHOWN IN FIG. 4
-20
0
20
40
60
(°C)
AMBIENT TEMPERATURE

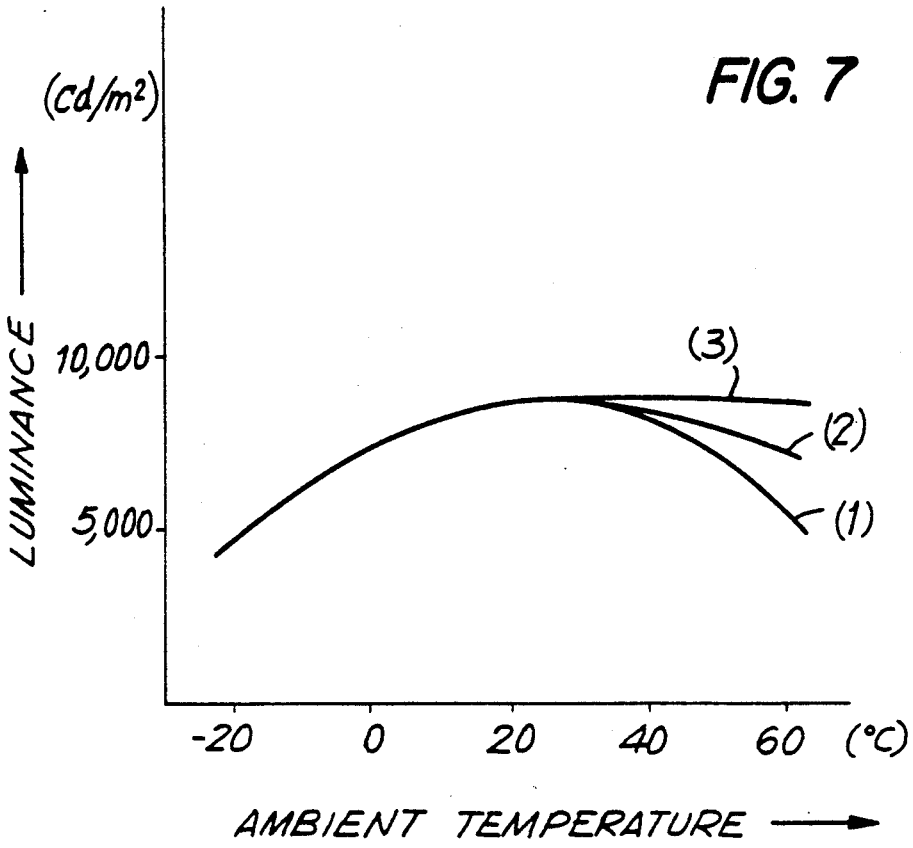
FIG. 7
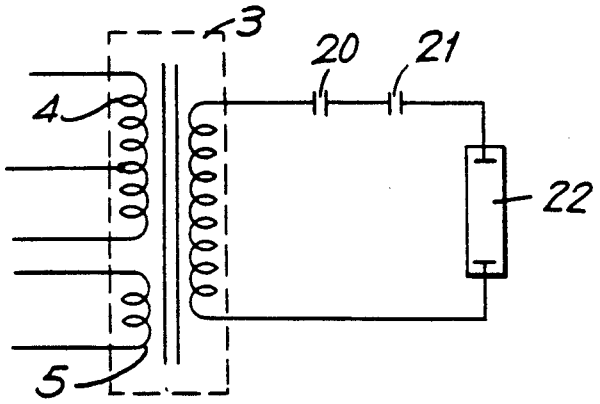
FIG. 8
FIG. 9
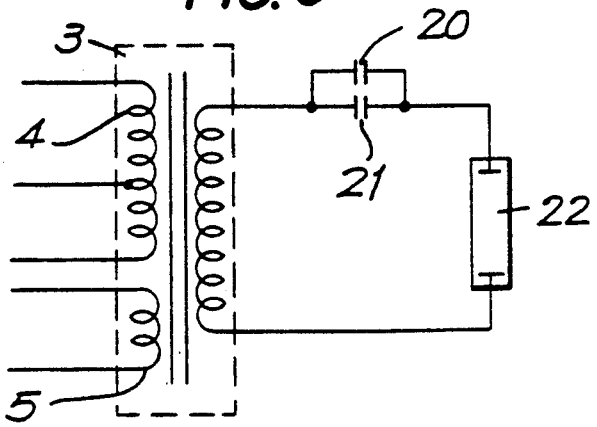

BACK-LIGHT DEVICE FOR A VIDEO DISPLAY APPARATUS

BACKGROUND OF THE INVENTION

This invention relates generally to a video display apparatus, and more particularly to a back-light device for illuminating a transmission-type video display plate within the video display apparatus.

A conventional video display apparatus which employs a video display plate such as a transmission-type liquid crystal panel requires that a light source be positioned behind the panel, that is, as a back-light device. Generally, a fluorescent lamp is used as the back-light device. The fluorescent lamp provides a high level of luminance, a high color temperature, a high level of effectivity and is relatively inexpensive. Unfortunately, a significant decrease in the level of luminance produced by the fluorescent lamp occurs at extremely low temperatures and especially at temperatures below the freezing point.

As shown in FIG. 2, the luminance characteristics of a cold cathode fluorescent lamp serving as a back-light device in a conventional video display apparatus varies based on ambient temperature conditions. More particularly, the level of luminance at low temperatures markedly decreases. At about −20° C., the level of luminance of a cold cathode fluorescent lamp is about one fourth the level of luminance produced by the cold cathode fluorescent lamp at normal ambient temperatures of about 25° C.–30° C.

To compensate for low levels of luminance at low ambient temperatures, the level of electric power provided to the back-light device is varied based on the ambient temperature. For example, as shown in FIG. 3, a back-light device 50 includes a battery 14 which supplies a voltage to a voltage regulator 15 which is further modified by a variable resistor 16. Based on ambient temperature conditions, variable resistor 16 is adjusted to provide a suitable voltage to operating circuit 17 which in turn provides a suitable voltage to fluorescent lamp 18 for the latter to produce an acceptable level of luminance.

Another method for adjusting the level of luminance of a fluorescent lamp is disclosed in Japanese Patent Laid-Open Application No. 58-80299. The Japanese application discloses a method for varying the oscillating frequency of a high frequency operating circuit by changing the value of a variable resistor based on the ambient temperature. Current flowing through the fluorescent lamp at low temperatures is increased to compensate for an otherwise low level of luminance.

Video display apparatuses for indoor use are not limited to any particular type of power source and can employ a variety of power sources for supplying power to their components (including direct connections to an electrical wall outlet). Power losses associated with these components is not a significant problem. Video display apparatuses for outdoor which include, for example, pocket size televisions and electronic viewfinders of video cameras are powered by a battery. Significant power losses associated with such video display apparatuses are undesirable and a serious drawback.

The luminance compensation technique illustrated in FIG. 3 requires a division of the voltage between voltage regulator 15 and the rest of the back-light device circuitry. In particular, a relatively large voltage drop is developed across voltage regulator 15. Power consumption increases.

The luminance compensation technique disclosed in the Japanese application requires the impedance of impedance elements which are part of the load be changed to increase or decrease the current flowing through the fluorescent lamp. Furthermore, although the method disclosed in the Japanese application consumes less power than circuit 50 of FIG. 3, the variable resistor required to change the oscillation frequency of the high frequency operating circuit must be adjusted manually (by hand) based on a temperature detector which detects the ambient temperature conditions. The range (width) of oscillating frequencies also must be increased (widened) to provide an adequate flow of current through the fluorescent lamp at low temperatures. An independent oscillation circuit is required. It is also difficult to increase the range of oscillating frequencies when using self-excited oscillation circuits which include transistors.

Accordingly, it is desirable to provide a back-light device for use with a video display apparatus which is not adversely influenced by low ambient temperature conditions. In particular, it is desirable to provide a back-light device which automatically maintains the level of luminance produced by a fluorescent lamp at a suitable level for video display purposes at low ambient temperatures.

SUMMARY OF THE INVENTION

Generally speaking, in accordance with the invention, a back-light device includes a light source for producing a varying level of luminance and which is characterized by a luminance-ambient temperature curve having a substantially positive slope at temperatures which are between about −20° C. and +10° C. The device also includes a ballast capacitor for controlling the level of luminance produced by the light source. The ballast capacitor is characterized by a capacitance-ambient temperature curve having a substantially negative slope at temperatures which are between about −20° C. and +10° C.

As the level of luminance decreases at low ambient temperatures, the capacitive reactance of the ballast decreases. An increase in the current flowing through the light source offsets the decrease in the level of luminance caused by the low ambient temperatures resulting in the production of an acceptable level of luminance for video display purposes.

The light source is typically a fluorescent lamp which can be either a cold-cathode type or a hot-cathode type. The ballast capacitor is electrically connected in series with the light source. A transformer, which powers the light source, includes a secondary winding which is electrically connected in series with the ballast capacitor. A push-pull circuit drives the transformer. The ballast capacitor can include a plurality of capacitors connected either electrically in series or electrically in parallel with each other. Preferably, at least one of the ballast capacitors is a ceramic capacitor.

In another aspect of the invention, the capacitance-ambient temperature curve of the ballast capacitor is further characterized by an either substantially zero slope or positive slope for ambient temperatures between about 40° C.–60° C.

Accordingly, it is an object of the invention to provide an improved back-light device which is not adversely influenced by either low or high ambient temperatures.

It is another object of the invention to provide an improved back-light device for use with a video display apparatus which automatically maintains the level of luminance produced by a fluorescent lamp at a suitable level at low and high ambient temperatures.

It is a further object of the invention to provide an improved video display apparatus which produces a display at a much higher level of luminance than conventional video display apparatuses during low ambient temperature conditions.

Still other objects and advantages of the invention will in part be obvious and will in part be apparent from the specification.

The invention accordingly comprises the several steps in a relation of one or more such steps with respect to each of the others, and the apparatus embodying features of construction, a combination of elements, and arrangements of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1(A) is a schematical diagram in accordance with an alternative embodiment of the invention;

FIG. 7 is a plot of luminances versus ambient temperature corresponding to the plot of FIG. 6;

FIG. 8 is a fragmented schematical diagram of a back-light device in accordance with a further alternative embodiment of the invention;

FIG. 9 is a fragmented schematical diagram illustrating yet another alternative embodiment of the invention.

DETAILED DESCRIPTION OF THE PREFERRED EMBODIMENTS

Figure 1:
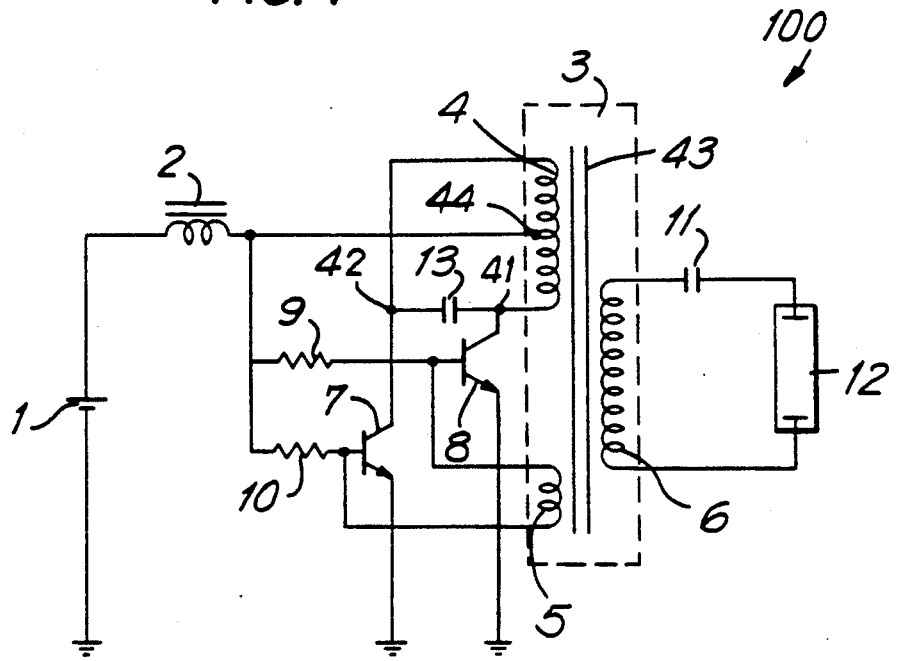
FIG. 1 is a schematical diagram of a back-light device in accordance with one embodiment of the invention.
Figure 2:
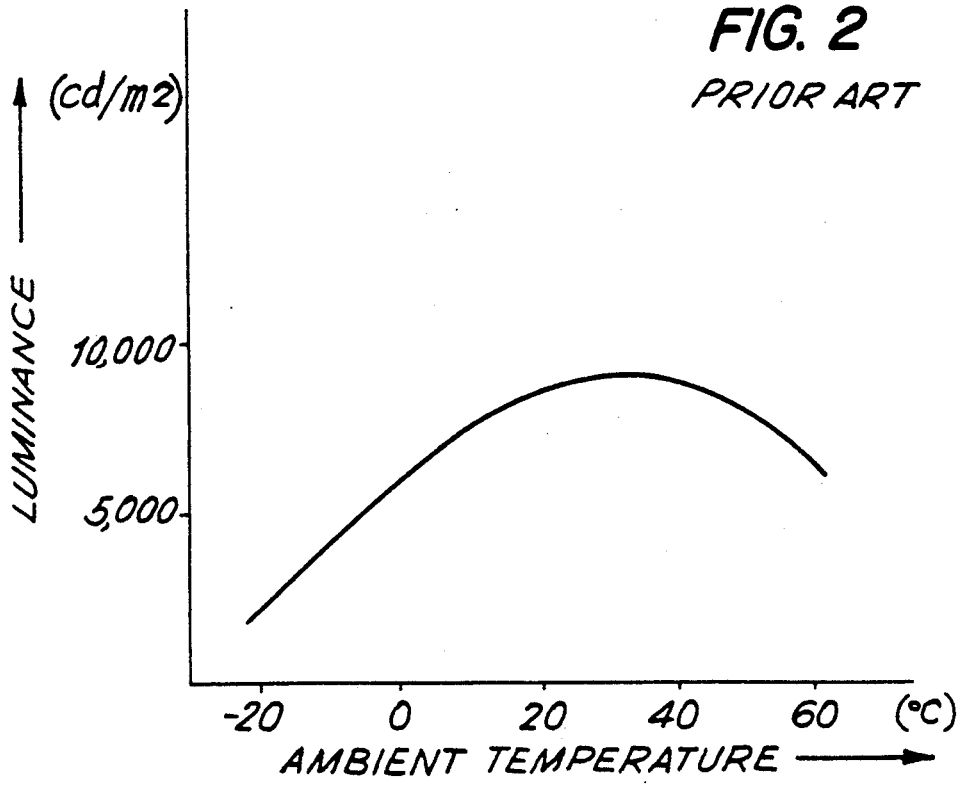
FIG. 2 PRIOR ART
FIG. 2 is a plot of luminance versus ambient temperature of a prior art back-light device.
Figure 3:
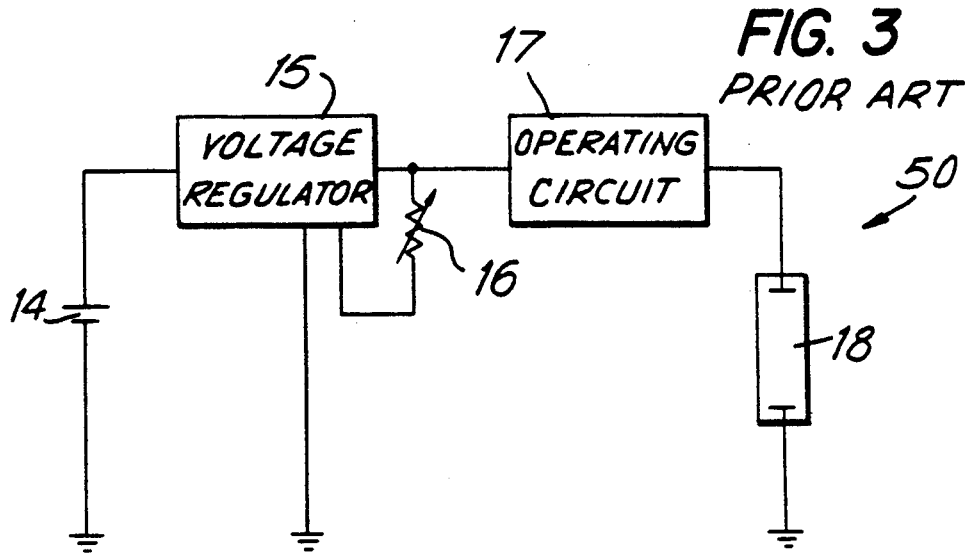
FIG. 3 PRIOR ART
FIG. 3 is a combined schematical diagram and block diagram of the prior art back-light device.

As shown in FIG. 1, a back-light device 100 includes a light source such as a cold cathode fluorescent lamp 12 which is powered by a self-excited push-pull oscillating circuit. A battery 1 is serially connected to a choke coil 2. When a transistor 8 is in a conductive state, current flows through a tap 44 and a first end 41 of a first winding 4 of a transformer 3 which induces a voltage in a winding 5 of transformer 3. As the voltage induced across coil 5 increases, transistor 8 becomes more conductive and eventually saturates based on positive feedback. First end 41 of coil 4 is connected to a collector of transistor 8 and to one side of a capacitor 13. A second end 42 of winding 4 is connected to the other side of capacitor 13 and to a collector of a transistor 7. A pair of resistors 9 and 10 are connected to a pair of bases of transistors 8 and 7, respectively.

As transistor 8 becomes more conductive, the magnetic flux of a core 43 of transformer 3 increases linearly until it is ultimately saturated. Once transformer 3 is saturated, the level of current flowing through transistor 8 increases rapidly and is ultimately limited by the driving voltage applied to its base by winding 5. Current flowing through transistor 8 is now at a maximum value. Thereafter, the voltage at ends 41 and 42 of winding 4 begin to decrease resulting in transistor 8 switching from a conductive to a non-conductive state. The voltage induced in winding 5 has a polarity which is opposite to the polarity of the voltage applied between tap 44 and end 41 of winding 4. Accordingly, as transistor 8 switches from a conductive to non-conductive state, transistor 7 switches from a non-conductive to conductive state. In particular, transistors 7 and 8 switch on and off at a rapid rate, respectively.

The push-pull circuit of back-light device 100 operates in a similar manner when transistor 7 is in a conductive state and transistor 8 is in a non-conductive state. Generation of a continuous oscillating signal across a winding 6 of transformer 3 results. The voltage across winding 6 is based on the ratio of the number of turns from tap 44 to end 41 of coil 4 and the number of turns of winding 6. The continuous oscillating signal across winding 6 is applied to cold cathode fluorescent lamp 12 through a capacitor 11. In particular, capacitor 11 provides an appropriate ballast current for lamp 12.

The level of luminance produced by lamp 12 is proportional to the current flowing therethrough. As the current flowing through lamp 12 increases, the luminance produced by lamp 12 increases.

As the capacitance of ballast capacitor 11 increases, its impedance decreases resulting in an increase in the luminance produced by lamp 12. A capacitor suitable for use as ballast capacitor 11 has a value of capacitance which is much greater at low temperatures than at normal temperatures. Such capacitors are characterized as having negative temperature factors. As used herein, normal temperatures are defined as temperatures of about 10° C.-30° C. Low temperatures are considered temperatures below the normal temperature range.

Figure 4:
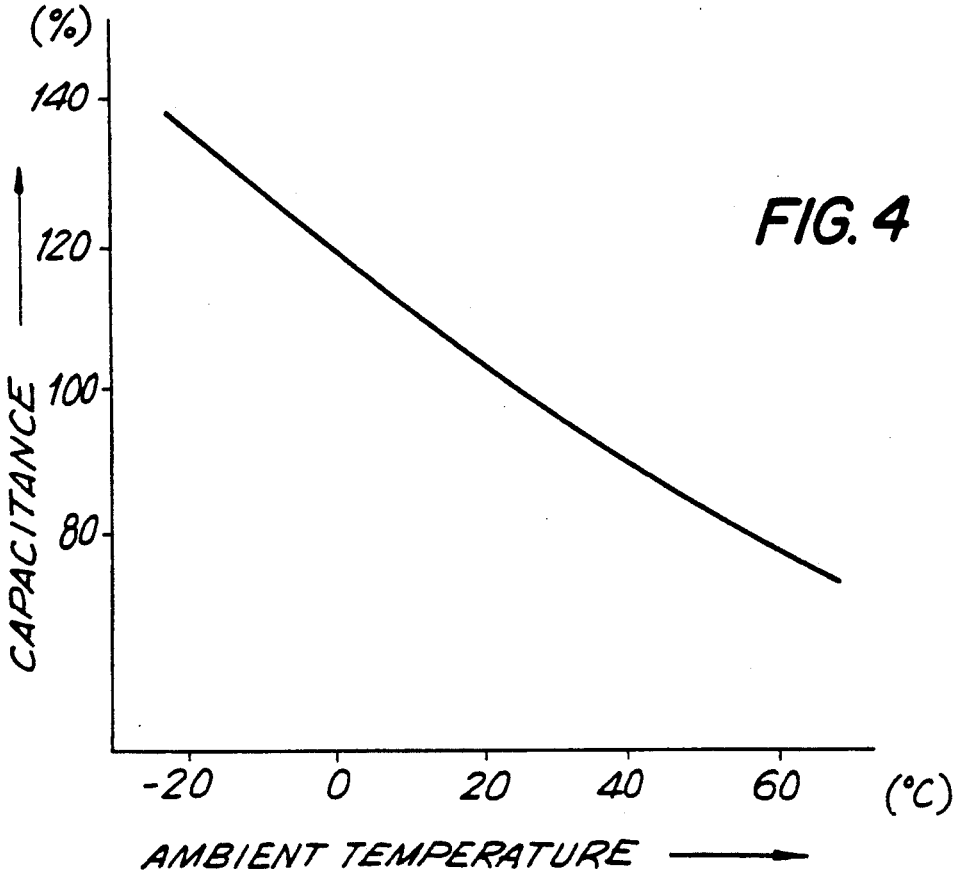
FIG. 4 is a plot of capacitance versus ambient temperature of a ballast capacitor in accordance with another alternative embodiment of the invention.

FIG. 4 illustrates the capacitance-ambient temperature characteristics of capacitor 11. Capacitor 11 is preferably a ceramic capacitor predominantly made from $SrTiO_3$ and having a Curie point of about −10° C. The capacitance of such a capacitor is about 30% greater at low temperatures than at a normal temperature of, for example, +25° C. Capacitors exhibiting such variation in capacitance include and are commonly referred to as a YN type, and Y5S type, a Y5T type or a D type.

Figure 5:
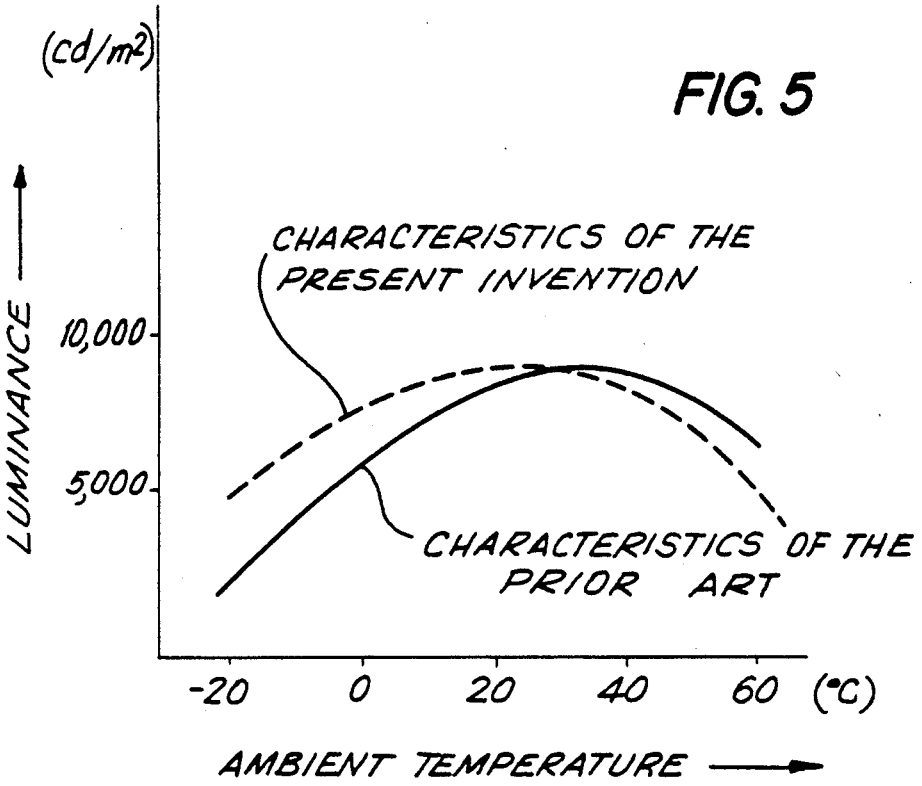
FIG. 5 is a plot of luminance versus ambient temperature illustrating the characteristics of a prior art back-light device and a back-light device in accordance with the invention.

FIG. 5 illustrates the luminance-ambient temperature characteristics of back-light device 100 compared to a conventional back-light device. Device 100 shows a significant improvement in the level of luminance at low ambient temperatures compared to the level of luminance produced by prior art back-light devices. In particular, the level of luminance produced by device 100 as compared to prior art back-light devices is about twice as great at ambient temperatures of about −20° C. Additionally, device 100 compared to prior art back-light devices produces a level of luminance which is about 30% greater at an ambient temperature of about 0° C. Device 100 significantly improves the level of luminance which can be produced by a back-light device at low ambient temperature levels.

Figure 6:
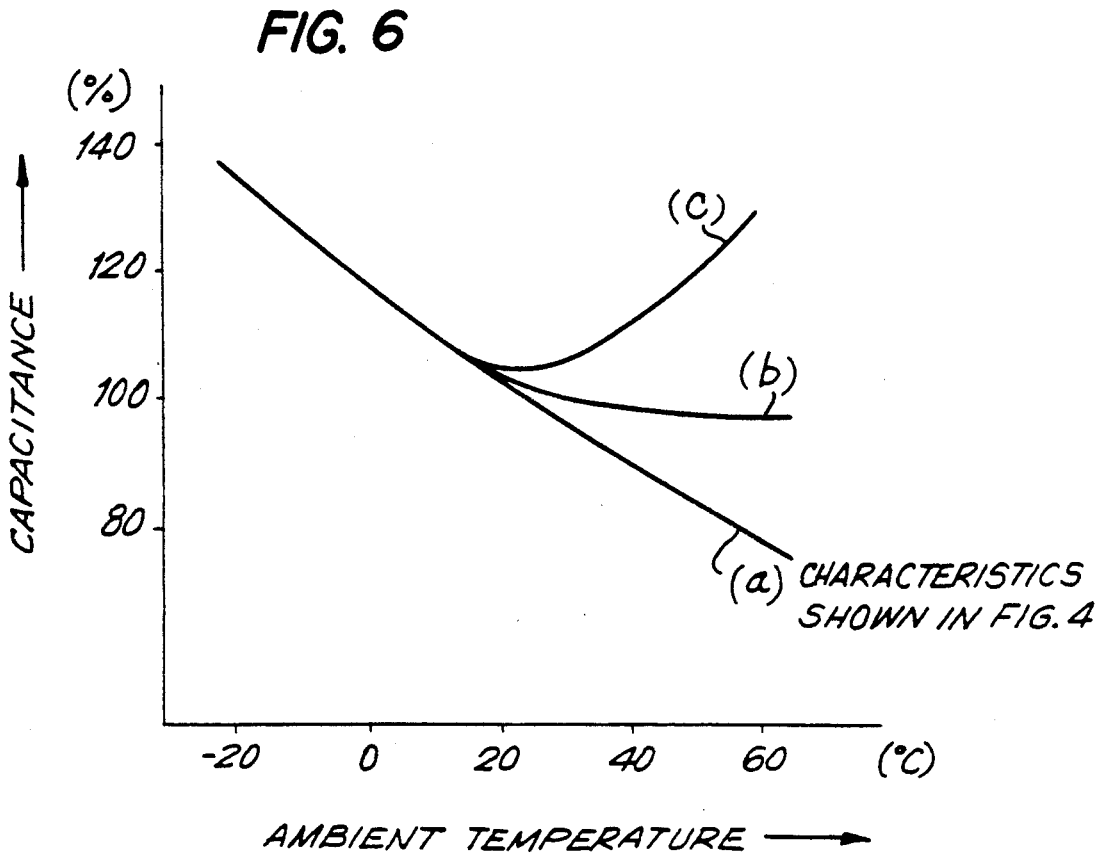
FIG. 6 is a plot of ballast capacitances versus ambient temperature in accordance with the invention.

As shown in FIG. 6, device 100 is not limited to the capacitance-ambient temperature characteristics of FIG. 4 and can exhibit a variety of different capacitance-ambient temperature characteristics at normal and above normal ambient temperatures. A curve (a) of FIG. 6 illustrates the temperature characteristics of ballast capacitor 11 illustrated in FIG. 4. A curve (b) has the same capacitance characteristics of curve (a) at below normal (low) temperatures but maintains a substantially constant capacitance level at above normal temperatures. A curve (c) also has the same capacitance characteristics as curve (a) at below normal temperatures. The value of capacitance of curve (c), however, increases at above normal temperatures (i.e., exhibits a positive temperature factor).

Referring once again to FIG. 5, the level of luminance produced by prior art back-light devices decreases at high temperatures (i.e., above 40° C.). Similarly, the luminance characteristics of curve (a) also decrease at high temperatures. Curve (b) of FIG. 6, however, substantially prevents a continual decrease in the level of luminance produced by device 100 at high temperatures (i.e., the capacitance effect is somewhat lessened). Reduction in the level of luminance at high temperatures is substantially eliminated by a ballast capacitor exhibiting the characteristics of curve (c).

FIG. 7 illustrates the luminance-ambient temperature characteristics of ballast capacitor 11 in which curves (1), (2) and (3) of FIG. 7 correspond to curves (a), (b) and (c) of FIG. 6, respectively. Device 100 provides much higher levels of luminance at low temperatures than prior art back-light devices although there is nevertheless a decrease in the level of luminance at temperatures below the normal temperature range. At high temperatures (i.e., above 40° C.) device 100 when using a ballast capacitor exhibiting the characteristics of curve (3) can maintain the level of luminance produced at normal temperatures. Accordingly, the level of luminance produced by device 100 can be significantly greater at both low and high temperatures compared to conventional back-light devices.

Although device 100 includes a single capacitor serving as ballast capacitor 11, it is to be understood that the same advantages can be achieved by using a plurality of capacitors serving as ballast capacitor 11 and having various capacitance-ambient temperature characteristics. The luminance compensation provided by ballast capacitor 11 at low temperatures is achieved through significant variations in capacitance as the ambient temperature changes (i.e., a large temperature factor). Preferably, the capacitance-ambient temperature characteristics of ballast capacitor 11 are substantially opposite to the luminance-temperature characteristics of cold-cathode fluorescent lamp 12. In particular, the negative slope of the capacitance-ambient temperature curve (i.e. positive slope of the capacitance reactance-ambient temperature curve) counteracts the positive slope of the luminance-ambient temperature curve between ambient temperatures of, for example, but not limited to, −20° C. to +10° C. whereby a substantial increase in the luminance produced by device 100 at low temperatures results.

FIGS. 8 and 9 illustrate alternative embodiments of the invention and, in particular, with respect to use of two or more capacitors for ballast capacitor 11. The circuitry attached to windings 4 and 5 of FIGS. 8 and 9 is the same as shown in FIG. 1.

As shown in FIG. 8, a capacitor 20 made, for example, but not limited to ceramic (e.g., YN type) having the capacitance-ambient temperature characteristics of FIG. 4 is connected to a capacitor 21 made, for example, from ceramic (SL type). Capacitor 21, which is serially connected between capacitor 20 and lamp 22, has a fairly flat capacitance-ambient temperature curve (i.e. small variation in the value of capacitance based on changes in the ambient temperature). Consequently, capacitor 21 serves to limit the flow of current through cold-cathode fluorescent lamp 22. In particular, the maximum capacitance value of ballast capacitor 11 is limited by capacitor 21. Therefore, a maximum flow of current through lamp 22 can be established.

As shown in FIG. 9, capacitors 20 and 21 are electrically connected in parallel. Consequently, the minimum capacitance value of ballast capacitor 11 at high temperatures is established by capacitor 21. The minimum flow of current through lamp 22 at high temperatures can be determined.

The embodiments of the invention described heretofore illustrate a self-excited push-pull circuit to generate an oscillating signal for back-light device 100. Alternatively, a separate exciting-type or single circuit for generating the oscillating signal can be used in providing a suitable voltage applied to ballast capacitor 11. The invention is not limited to use of a cold-cathode fluorescent lamp and can include, but is not limited to, use of a hot-cathode fluorescent lamp as the light source.

The capacitance-ambient temperature characteristics of capacitor 11 for ballasting the flow of current through light source 12 have been described heretofore. Alternatively, as shown in FIG. 1(A), suitable ballasting can be obtained using a temperature impedance converter such as a resistor, thermistor or inductor 11a provided such impedance converter exhibits the luminance compensation effects at high and/or low temperatures previously disclosed. Such temperature-impedance converter can be used in lieu of or in combination with ballast capacitor 11.

Figure 10:
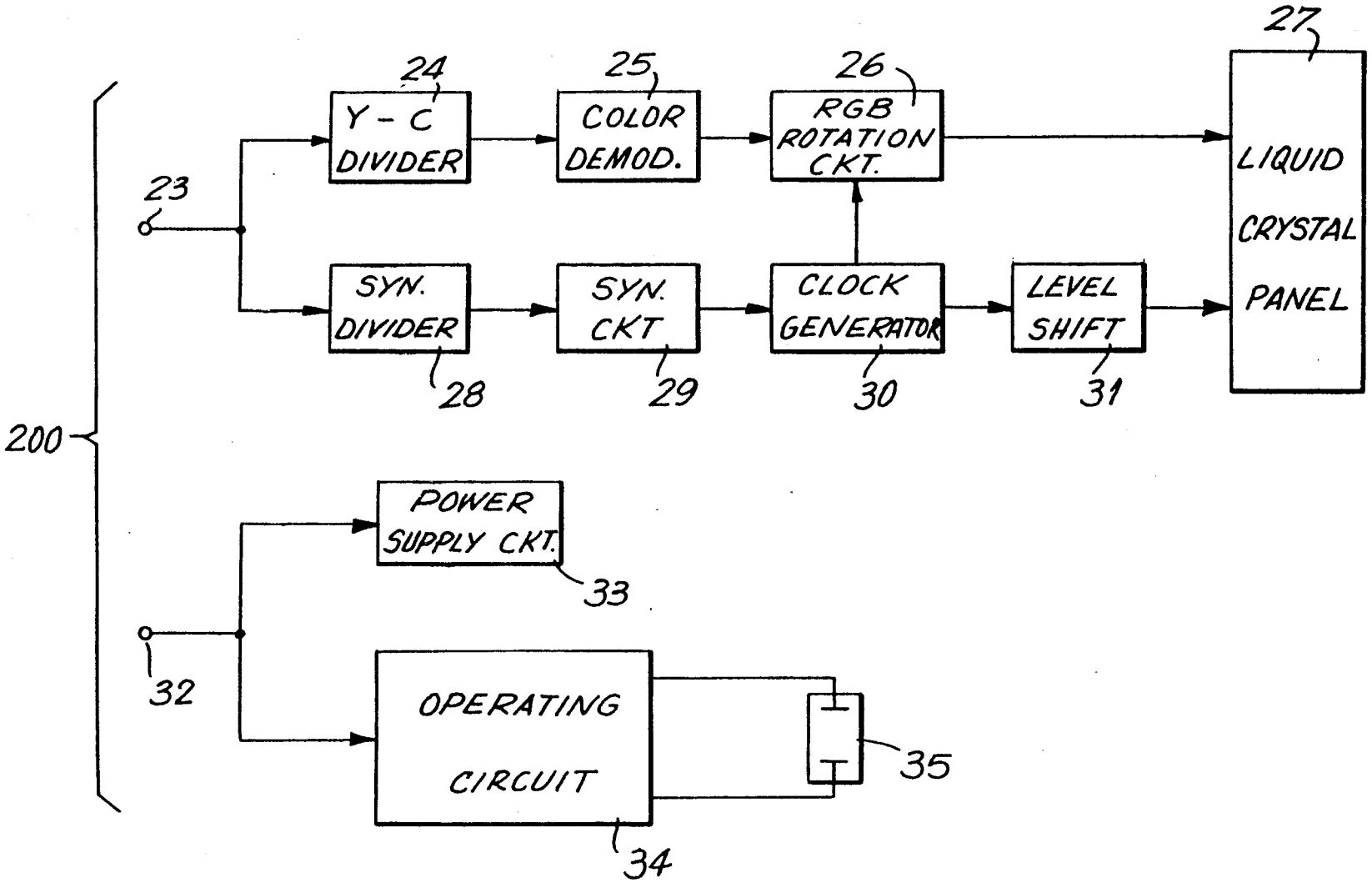
FIG. 10 is a block diagram of a video display apparatus.

FIG. 10 is a block diagram illustrating a video display apparatus 200. Apparatus 200 can be used, for example, in a color liquid crystal electronic view finder having a color liquid crystal panel for use with a video camera. Video composite signals are provided to an input 23. A portion of the video composite signals are then supplied to a Y-C dividing circuit 24 for separating the luminance signals from the color signals. The color signals are then passed through a color demodulating circuit 25 which produces three original color signals R, G and B. The three original color signals then are supplied to an RGB rotation circuit for rotating the three original colors based on the RGB pattern of a color filter. The output from RGB rotation circuit 26 is inputted to a liquid crystal display panel 27.

The other portion of the video composite signals supplied to input 23 are inputted to a synthesizing dividing circuit 28. The output of synthesizing dividing circuit 28 is provided to a synthesizing circuit 29 which generates synthesizing signals. The synthesizing signals are provided to liquid crystal display panel 27 through a level shift circuit 31 and a clock generator 30 to provide a suitable clock for driving liquid crystal panel 27.

Liquid crystal panel 27 is an active matrix type with a built in shift register and a built in driver. Power is supplied to an input 32 from the video camera. A switching power supply battery circuit 33 receives the power from input 32 and generates suitable voltages for operating video display apparatus 200. Power is also supplied to an operating circuit 34 of a back-light device in accordance with the invention. A suitable level of voltage is applied across a light source such as a cold-cathode fluorescent lamp 35. Switching power supply battery circuit 33 can be used as a common circuit in cooperation with operating circuit 34 to further improve the effective supply of power to device 200. Operating circuit 34 of a back-light device in accordance with the invention compensates for low levels of luminance at low and high ambient temperatures as discussed heretofore.

Back-light device 100 also can be used in other types of video display apparatuses including, but not limited to, a video tape recorder having a built in liquid crystal display panel, a liquid crystal television or a liquid crystal display projector. It is to be understood that the invention is not limited to light sources in which the transmission-type display element is a liquid crystal display panel and that other transmission-type display elements can be used with the invention.

Video display apparatuses when used outdoors require a battery as a source of power. Minimizing power demands of the battery as provided by the invention are extremely advantageous.

As now can be readily appreciated, the invention prevents reduction in the level of luminance produced by a fluorescent lamp at low temperatures (e.g., below about +10° C.) by increasing the value of capacitance of ballast capacitor 11 at these low temperatures. The invention also prevents reduction in the level of luminance produced by a fluorescent lamp at high temperatures (e.g., at about +40° C. or greater) by minimizing the reduction in capacitance at such high temperatures. As illustrated by curve (3) of FIG. 7, reduction in the level of luminance at high temperatures can be substantially eliminated.

Accordingly, the invention substantially avoids reduction in the level of luminance at high and low temperatures. Poorly lit displays are eliminated. No additional controls and/or manual operations or additional components such as an independent oscillating circuit are required. Temperature compensation to provide a suitable level of luminance is automatically carried out by the invention. Miniaturization of the back-light device operating at a high level of reliability can be achieved. Furthermore, inasmuch as the flow of current through the fluorescent lamp increases only when the level of luminance due to high or low ambient conditions is present, power consumption at normal ambient temperatures is avoided.

The reduction in power consumption extends the life of the battery. Alternatively, if the lifetime of the battery is not to be extended, the size of the battery can be reduced (i.e., miniaturized). Consequently, the invention advantageously permits miniaturization of the back-light device. Still further, the invention can accommodate fluorescent lamps having a variety of different luminance-ambient temperature characteristics and is not limited to select few types of fluorescent lamps.

It will thus be seen that the object set forth above, and those made apparent from the preceding description are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and that all statements of the scope of the invention, which as a matter of language, might be said to fall therebetween.

What is claimed is:

1. A back-light device, comprising:

light source means for producing a varying level of luminance and which is characterized by a luminance-ambient temperature curve having a substantially positive slope at temperatures which are between about −20° C. and +10° C.; and ballast means for controlling the level of luminance produced by the light source means and which is characterized by a capacitance-ambient temperature curve having a substantially negative slope at temperatures between about −20° C. and +10° C.

2. The back-light device of claim 1, wherein the light source means is a fluorescent lamp.

3. The back-light device of claim 2, wherein the fluorescent lamp is a cold-cathode type.

4. The back-light device of claim 2, wherein the fluorescent lamp is a hot-cathode type.

5. The back-light device of claim 1, wherein the ballast means and light source means are electrically connected in series.

6. The back-light device of claim 1, further including transformer means for producing an alternating current to power the light source means.

7. The back-light device of claim 5, further including transformer means for producing an alternating current to power the light source means.

8. The back-light device of claim 7, wherein the transformer means includes a winding electrically connected in series with the ballast means.

9. The back-light device of claim 6, further including a push-pull oscillator for driving the transformer means.

10. The back-light device of claim 8, further including a push-pull oscillator for driving the transformer means.

11. A back-light device, comprising:

light source means for producing a varying level of luminance and which is characterized by a luminance-ambient temperature curve having a substantially positive slope at temperatures between −20° C. and +10° C.; and ballast means for controlling the level of luminance produced by the light source means and which is characterized by a impedance-ambient temperature curve having a substantially positive slope at temperatures which are between −20° C. and +10° C.

12. The back-light device of claim 11, wherein the light source means is a fluorescent lamp.

13. The back-light device of claim 12, wherein the fluorescent lamp is a cold-cathode type.

14. The back-light device of claim 12, wherein the fluorescent lamp is a hot-cathode type.

15. The back-light device of claim 11, wherein the ballast means is a thermistor.

16. The back-light device of claim 11, wherein the ballast means is an inductor.

17. The back-light device of claim 11, wherein the ballast means and light source means are electrically connected in series.

18. The back-light device of claim 12, wherein the ballast means and light source means are electrically connected in series.

19. The back-light device of claim 11, further including transformer means for producing an alternating current to power the light source means.

20. The back-light device of claim 17, further including transformer means for producing an alternating current to power the light source means.

21. The back-light device of claim 20, wherein the transformer means includes a winding electrically connected in series with the ballast means.

22. The back-light device of claim 21, further including a push-pull oscillator for driving the transformer means.

23. The back-light device of claim 1, wherein the ballast means includes at least one ceramic capacitor.

24. The back-light device of claim 1, wherein the ballast means includes more than one capacitor electrically connected in parallel.

25. The back-light device of claim 1, wherein the ballast means includes more than one capacitor electrically connected in series.

26. The back-light device of claim 24, wherein at least one capacitor is a ceramic capacitor.

27. The back-light device of claim 25, wherein at least one capacitor is a ceramic capacitor.

28. A video display apparatus including back-light device, said apparatus comprising:

light source means for producing a varying level of luminance and which is characterized by a luminance-ambient temperature curve having a substantially positive slope at temperatures between about −20° C. and +10° C.;

ballast means for controlling the level of luminance produced by the light source means and which is characterized by a capacitance-ambient temperature curve having a substantially negative slope at temperatures which are between about −20° C. and +10° C.; and display means lit by the luminance of said light source means for display of an image.

29. The video display apparatus of claim 28, wherein the light source means is a fluorescent lamp.

30. The video display apparatus of claim 29, wherein the fluorescent lamp is a cold-cathode type.

31. The video display apparatus of claim 29, wherein the fluorescent lamp is a hot-cathode type.

32. The video display apparatus of claim 28, wherein the ballast means and light source means are electrically connected in series.

33. The video display apparatus of claim 28, further including transformer means for producing an alternating current to power the light source means.

34. The video display apparatus of claim 33, further including transformer means for producing an alternating current to power the light source means.

35. The video display apparatus of claim 34, wherein the transformer means includes a winding electrically connected in series with the ballast means.

36. The video display apparatus of claim 33, further including a push-pull oscillator for driving the transformer means.

37. The video display apparatus of claim 35, further including a push-pull oscillator for driving the transformer means.

38. A video display apparatus including a back-light device, said apparatus comprising:

light source means for producing a varying level of luminance and which is characterized by a luminance-ambient temperature curve having a substantially positive slope at temperatures between about −20° C. and +10° C.;

ballast means for controlling the level of luminance produced by the light source means and which is characterized by an impedance-ambient temperature curve having a substantially positive slope at temperatures between about −20° C. and +10° C.; and display means lit by the luminance of said light source means for display of an image.

39. The video display apparatus of claim 38, wherein the light source means is a fluorescent lamp.

40. The video display apparatus of claim 39, wherein the fluorescent lamp is a cold-cathode type.

41. The video display apparatus of claim 39, wherein the fluorescent lamp is a hot-cathode type.

42. The video display apparatus of claim 38, wherein the ballast means is a thermistor.

43. The video display apparatus of claim 38, wherein the ballast means is an inductor.

44. The video display apparatus of claim 38, wherein the ballast means and light source means are electrically connected in series.

45. The video display apparatus of claim 39, wherein the ballast means and light source means are electrically connected in series.

46. The video display apparatus of claim 38, further including transformer means for producing an alternating current to power the light source means.

47. The video display apparatus of claim 44, further including transformer means for producing an alternating current to power the light source means.

48. The video display apparatus of claim 47, wherein the transformer means includes a winding electrically connected in series with the ballast means.

49. The video display apparatus of claim 48, further including a push-pull oscillator for driving the transformer means.

50. The video display apparatus of claim 28, wherein the ballast means includes at least one ceramic capacitor.

51. The video display apparatus of claim 28, wherein the ballast means includes more than one capacitor electrically connected in parallel.

52. The video display apparatus of claim 28, wherein the ballast means includes more than one capacitor electrically connected in series.

53. The video display apparatus of claim 51, wherein at least one capacitor is a ceramic capacitor.

54. The video display apparatus of claim 52, wherein at least one capacitor is a ceramic capacitor.

55. The back-light device of claim 1, wherein the capacitance-ambient temperature curve is further characterized by a substantially zero slope for ambient temperatures between about 40° C.–60° C.

56. The back-light device of claim 1, wherein the capacitance-ambient temperature curve is further characterized by a substantially positive slope for ambient temperatures between 40° C.–60° C.

57. The video-display apparatus of claim 28, wherein the display means includes a transmission-type video display plate which is illuminated by the light source means.

58. The video-display apparatus of claim 38, wherein the display means includes a transmission-type video display plate which is illuminated by the light source means.

59. A method of illuminating the rear of a transmission-type video display plate of a video display apparatus comprising:

varying the level of luminance directed toward the plate and produced by a fluorescent lamp based on the ambient temperature wherein the lamp is characterized by a luminance-ambient temperature curve having a positive slope between about −20° C. and +10° C.; and controlling the variations in luminance based on a ballast changing the flow of current supplied to the lamp wherein said ballast is characterized by a capacitance-ambient temperature curve having a negative slope between about −20° C. and +10° C.

* * * * *